US009874393B2

(12) United States Patent
Rackley et al.

(10) Patent No.: US 9,874,393 B2
(45) Date of Patent: Jan. 23, 2018

(54) RAIL DOOR BIN SYSTEM

(71) Applicant: Electrolux Home Products, Inc., Charlotte, NC (US)

(72) Inventors: Timothy Bryan Rackley, Easley, SC (US); Adam Ellis, Anderson, SC (US); Andrew D. Brown, Anderson, SC (US); Justin Elgin, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/177,569

(22) Filed: Jun. 9, 2016

(65) Prior Publication Data

US 2016/0290706 A1 Oct. 6, 2016

Related U.S. Application Data

(62) Division of application No. 13/910,832, filed on Jun. 5, 2013, now Pat. No. 9,389,012.

(51) Int. Cl.
*A47B 96/04* (2006.01)
*F25D 23/02* (2006.01)
(Continued)

(52) U.S. Cl.
CPC ..... *F25D 23/028* (2013.01); *F25D 11/00* (2013.01); *F25D 23/04* (2013.01); *F25D 25/00* (2013.01); *A47B 96/067* (2013.01)

(58) Field of Classification Search
CPC ..... A47F 5/0846; A47F 5/0807; F25D 23/04; F25D 23/028; F25D 23/066; F25D 23/067; A47B 96/067; A47B 57/567
See application file for complete search history.

(56) References Cited

U.S. PATENT DOCUMENTS 255,695 A * 3/1882 Taylor ..... A47B 57/567 248/244
427,462 A * 5/1890 Crider ..... A47B 57/567 248/244
(Continued)

FOREIGN PATENT DOCUMENTS

DE 29502535 U1 * 6/1996 ..... A47B 96/067
EP 0707184 4/1996
(Continued)

OTHER PUBLICATIONS

International Search Report and Written Opinion issued in Application No. PCT/US2014/039310 dated Oct. 13, 2014.

*Primary Examiner* — Daniel J Troy
*Assistant Examiner* — Andres F Gallego
(74) *Attorney, Agent, or Firm* — Pearne & Gordon LLP

(57) ABSTRACT

A storage system for storing food items in a temperature-controlled environment includes a rail attached to a liner panel. The rail includes at least one mounting structure that passes through an aperture in the liner panel. A bin has an arm extending from a rear surface of the bin. The bin is placed in a storage position. The arm is placed between the rail and the liner panel when the bin is placed in the storage position. Another example of the storage system and refrigeration appliance includes a foot extending from a rear surface of the bin. Yet another example includes interaction between a bin tab and a plurality of bumps on the rail to prevent side to side motion.

8 Claims, 9 Drawing Sheets

(51) Int. Cl.

| | |
|---|---|
| ***F25D 23/04*** | (2006.01) |
| ***F25D 25/00*** | (2006.01) |
| ***F25D 11/00*** | (2006.01) |
| *A47B 96/06* | (2006.01) |

(56) References Cited

U.S. PATENT DOCUMENTS

| | | | | | |
|---|---|---|---|---|---|
| 3,409,260 | A | | 11/1968 | Bleed | |
| 3,464,212 | A | | 9/1969 | Yamagata | |
| 3,647,075 | A | | 3/1972 | Aue | |
| 3,698,565 | A | | 10/1972 | Weber | |
| 3,886,698 | A | | 6/1975 | Raith | |
| 4,008,872 | A | * | 2/1977 | Thompson | A47B 96/067 211/88.01 |
| 4,174,486 | A | * | 11/1979 | Winkler | A47B 57/567 108/152 |
| 4,615,448 | A | | 10/1986 | Johnstonbaugh | |
| 4,779,939 | A | | 10/1988 | Stich | |
| 4,826,022 | A | * | 5/1989 | Duarte | A47F 5/0846 211/59.1 |
| 5,018,323 | A | | 5/1991 | Clausen | |
| 5,138,803 | A | | 8/1992 | Grossen | |
| 5,549,379 | A | | 8/1996 | Jun | |
| 5,638,962 | A | * | 6/1997 | Price, Jr. | A47B 81/068 206/387.15 |
| 5,791,093 | A | | 8/1998 | Diamond | |
| 6,085,542 | A | | 7/2000 | Johnson | |
| 6,582,038 | B2 | | 6/2003 | Moreno-Olguin et al. | |
| 7,300,120 | B2 | | 11/2007 | Shin | |
| D589,728 | S | | 4/2009 | Shaha et al. | |
| 7,748,805 | B2 | | 7/2010 | Lucas et al. | |
| 7,766,437 | B2 | | 8/2010 | Lim et al. | |
| 7,798,339 | B2 | * | 9/2010 | Brooks | G11B 33/02 211/103 |
| 7,992,728 | B2 | * | 8/2011 | Burgess | A47F 5/0056 211/126.15 |
| 2004/0149669 | A1 | | 8/2004 | Tomonari et al. | |
| 2007/0159041 | A1 | | 7/2007 | Lucas et al. | |
| 2008/0231159 | A1 | | 9/2008 | Lee et al. | |
| 2013/0081421 | A1 | | 4/2013 | Kwon et al. | |

FOREIGN PATENT DOCUMENTS

| | | |
|---|---|---|
| GB | 2203028 | 10/1988 |
| KR | 20020068929 | 8/2002 |
| NL | 6706574 | 11/1967 |
| WO | 9321487 | 10/1993 |
| WO | 98/08036 | 2/1998 |
| WO | 98/08037 | 2/1998 |
| WO | 2010/112296 | 10/2010 |

* cited by examiner

RAIL DOOR BIN SYSTEM

CROSS-REFERENCE TO RELATED APPLICATIONS

This application is a divisional application and claims the benefit of U.S. application Ser. No. 13/910,832, filed Jun. 5, 2013, the entire disclosure of which is hereby incorporated herein by reference.

BACKGROUND OF THE INVENTION

1. Field of the Invention

This application relates generally to a storage system for a refrigeration appliance, and more specifically to a storage system including a rail attached without the use of fasteners to a liner panel while eliminating the need for undercuts in the liner panel.

2. Description of Related Art

One configuration of a conventional refrigeration appliance includes at least one door to provide access to a fresh food compartment or a freezer compartment, allowing access to the stored items within the refrigeration appliance. Conventional refrigeration appliances typically include shelves or bins mounted to the interior of the door for storing fresh and frozen food items within the compartment. Such a configuration is convenient, as door-mounted bins increase the amount of storage space that is easily accessed by the user, rather than having to reach into the interior areas of the refrigerator. Door-mounted bins can also provide the convenience of configurations beneficial to store items such as bottles, cans, and/or other food or beverage containers.

However, the manufacturing ease of liner panels configured for door-mounted bins is often lessened due to the need for undercuts in the liner panel. Undercuts are zones which cannot be formed with a simple mold structure and require "action," or movable parts within one of the mold cavities. These movable parts increase the cost of the molds. Additionally, some solutions for fastening rails to the liner panel require fasteners and fittings located behind the liner panel, in the volume between the liner panel and the door exterior. This configuration requires additional time, labor, and expense in the assembly process. Accordingly, improvements to refrigeration appliance storage bins and their mounting structures are desired.

SUMMARY

The following presents a simplified summary in order to provide a basic understanding of some example aspects of the disclosure. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

According to one aspect, the subject application involves a refrigeration appliance including a compartment within the refrigeration appliance for storing food items in a refrigerated environment. The refrigeration appliance also includes a refrigeration system for providing a cooling effect within the compartment. The refrigeration appliance further includes a door attached to the refrigeration appliance. The door provides access to the compartment and the door includes a liner panel and a storage system. The storage system includes a rail attached to the liner panel. The rail includes at least one mounting structure that passes through an aperture in the liner panel. The storage system also includes a bin. The bin includes an arm extending from a rear surface of the bin. At least a portion of the arm is placed between the rail and the liner panel when the bin is placed in a storage position.

According to another aspect, the subject application involves a storage system for storing food items in a temperature-controlled environment. The storage system includes a rail attached to a liner panel. The rail includes at least one mounting structure that passes through an aperture in the liner panel. The storage system also includes a bin. The bin includes an arm extending from a rear surface of the bin. At least a portion of the arm is placed between the rail and the liner panel when the bin is placed in a storage position.

According to yet another aspect, the subject application involves a storage system for storing food items in a temperature-controlled environment. The storage system includes a rail which includes a plurality of bumps and at least one mounting structure. The rail is attached to a liner panel. The storage system also includes a bin. The bin includes an arm extending from a rear surface of the bin. At least a portion of the arm is placed between the rail and the liner panel when the bin is placed in a storage position. The bin also includes at least one bin tab. The bin tab interacts with the bumps of the rail in order to prevent side to side movement of the bin when the bin is placed in the storage position.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

DETAILED DESCRIPTION

Figure 1:
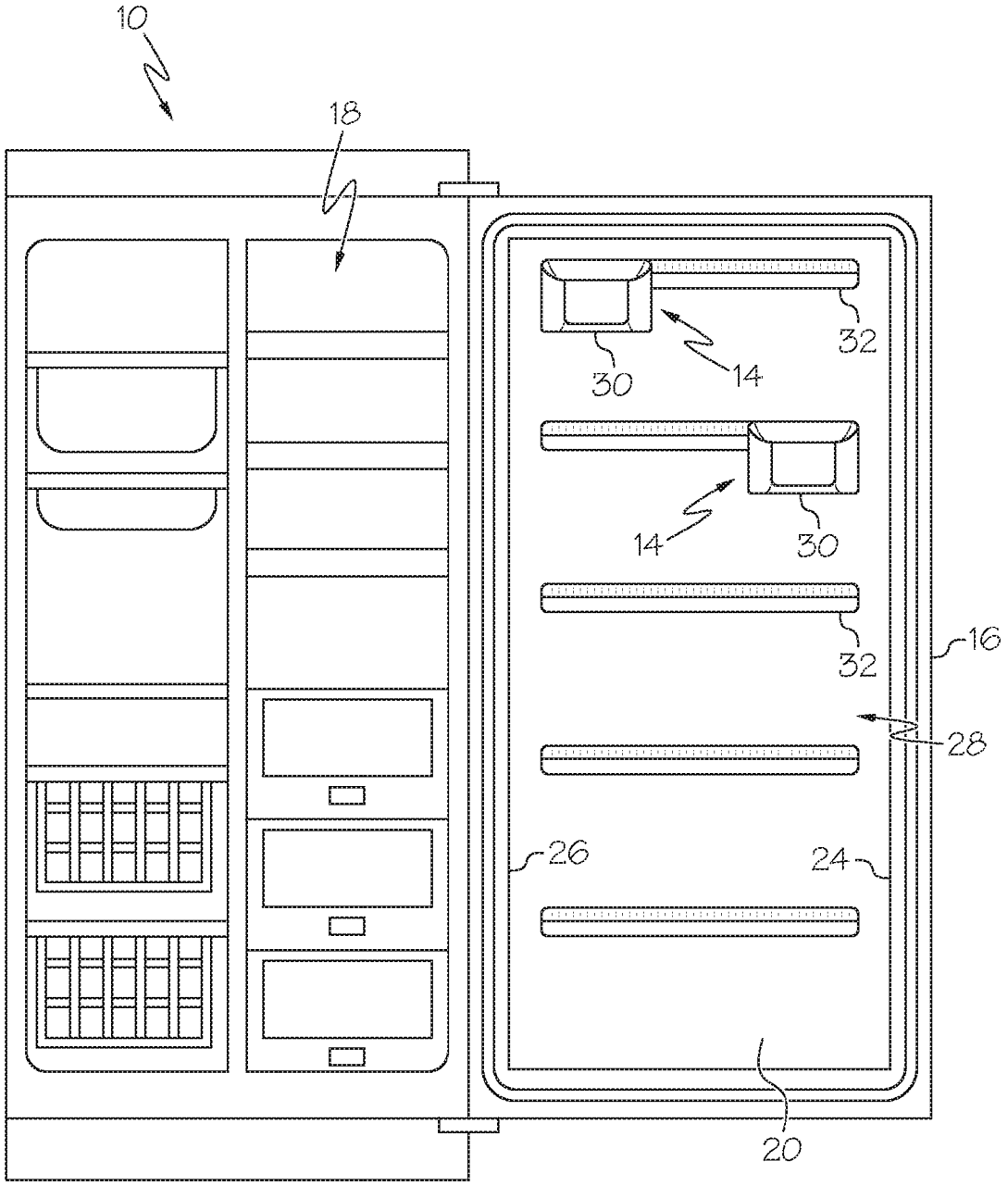
FIG. 1 is a schematic view of a refrigerator including a schematic depiction of an example storage system in accordance with aspects of the present disclosure.

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation on the present disclosure. Still further, in the drawings, the same reference numerals are employed for designating the same elements.

For the purposes of this disclosure, the term bin is used generically to describe any number of bins, shelves, or other similar structures used to support items. In one example, the bin can include a substantially flat surface with walls extending upward from the flat surface. Other examples can include wire-frame constructions, shelves designed to hold cans, shelves designed to hold dairy products, etc.

FIG. 1 depicts a schematic view of a refrigeration appliance such as refrigerator 10 including a schematic depiction of example storage system 14 in accordance with aspects of the present invention. It is to be appreciated that the view of FIG. 1 omits some detail of the storage system 14 for simplicity. The refrigerator 10 can include a door 16 which provides access to a compartment 18 which can include a refrigerator compartment, a freezer compartment, or any other type of compartment. For example, the compartment 18 can be configured for storing food items in a temperature-controlled environment having a target temperature. The door 16 can include a plurality of interior walls, such as a rear wall 20, a right wall 24, and a left wall 26. In one example, the rear wall 20, the right wall 24, and the left wall 26 can all be portions of one unitary door liner component such as liner panel 28. While not shown, the refrigerator 10 can include a refrigeration system for providing a cooling effect to the compartment 18.

The storage system 14 can be configured to be mounted to the door 16 of the refrigerator 10. The storage system 14 is configured to enable selective horizontal sliding of at least one bin 30 along a continuum of locations on a rail 32 mounted on the door 16. FIG. 1 shows a number of storage systems 14 at various elevations of the door 16. The storage system includes a rail 32.

Figure 2:
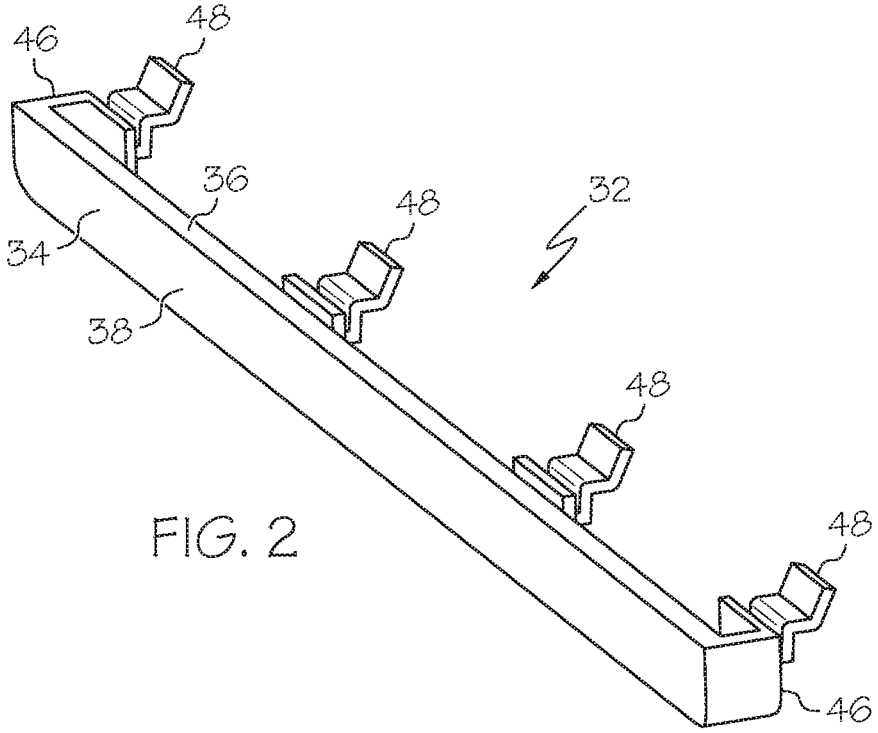
FIG. 2 is a perspective view of an example storage system including a rail mounted to a door of the refrigerator in FIG. 1.

In FIG. 2, a perspective view of the rail 32 in one example of the subject invention is shown. In this example, the rail 32 includes a substantially vertical portion 34 having a top surface 36, a front-facing surface 38, and a rear-facing surface 40 (best seen in FIG. 3). Other structure can also be included on the rail 32 such as a bottom portion 44 and two side portions 46. The rail 32 also includes at least one mounting structure such as tab 48 as shown. It is to be appreciated that any number of tabs 48 can be attached to the rail 32 in any suitable fashion. In the shown example, two of the tabs 48 are attached to the bottom portion 44 of the rail 32 and two tabs 48 are attached to the bottom portion 44 and the side portions 46. The attachment of the tabs 48 shown in FIG. 2 is merely an example and is not meant to limit the present disclosure. FIG. 2 also shows the two end tabs 48 as vertically offset from the two interior tabs 48, however, any suitable arrangement of vertical orientations for the tabs 48 can be used.

Figure 3:
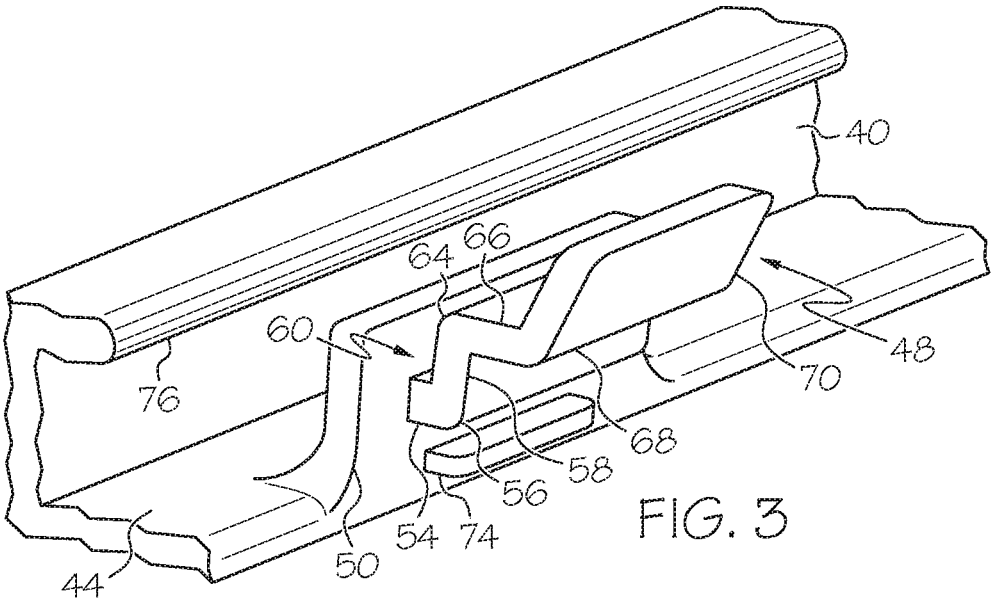
FIG. 3 is a detail view of a tab from the example rail of FIG. 2.

Turning to FIG. 3, a detail view of the tab 48 is shown. Here, the tab 48 is mounted to a substantially vertical wall 50 that is attached to the bottom portion 44 of the rail 32. The tab 48 can have a number of sections as it extends in a rearward direction from the rail 32. For example, the tab can include a substantially horizontal section 54. A bend 56 in the tab 48 connects section 54 to a substantially vertical section 58. A space 60 is at least partially defined by the wall 50 and section 58. Another bend 64 in the tab 48 connects section 58 with a substantially horizontal section 66. The tab 48 can also include a bend 68 connecting an angled section 70 to section 66. Bend 68 can include any suitable angle. The rail 32 can also include a horizontal ridge 74 extending rearward from the wall 50.

FIG. 3 also shows the rail 32 further including a substantially horizontal first protrusion 76 on a rear-facing surface 78 of the rail 32. As shown, the first protrusion 76 can be located at an upper end of the vertical portion 34, however, any suitable location can be used. The first protrusion 76 interacts with other structure which will be described below. In one example, the rail 32, the tab 48, the wall 50, the ridge 74, and the first protrusion 76 can be formed together as a unitary structure, such as a molded plastic. In a further example, these components can be formed by molded acrylonitrile butadiene styrene (ABS) plastic, however, any suitable material can be used to form the rail 32.

Figure 4:
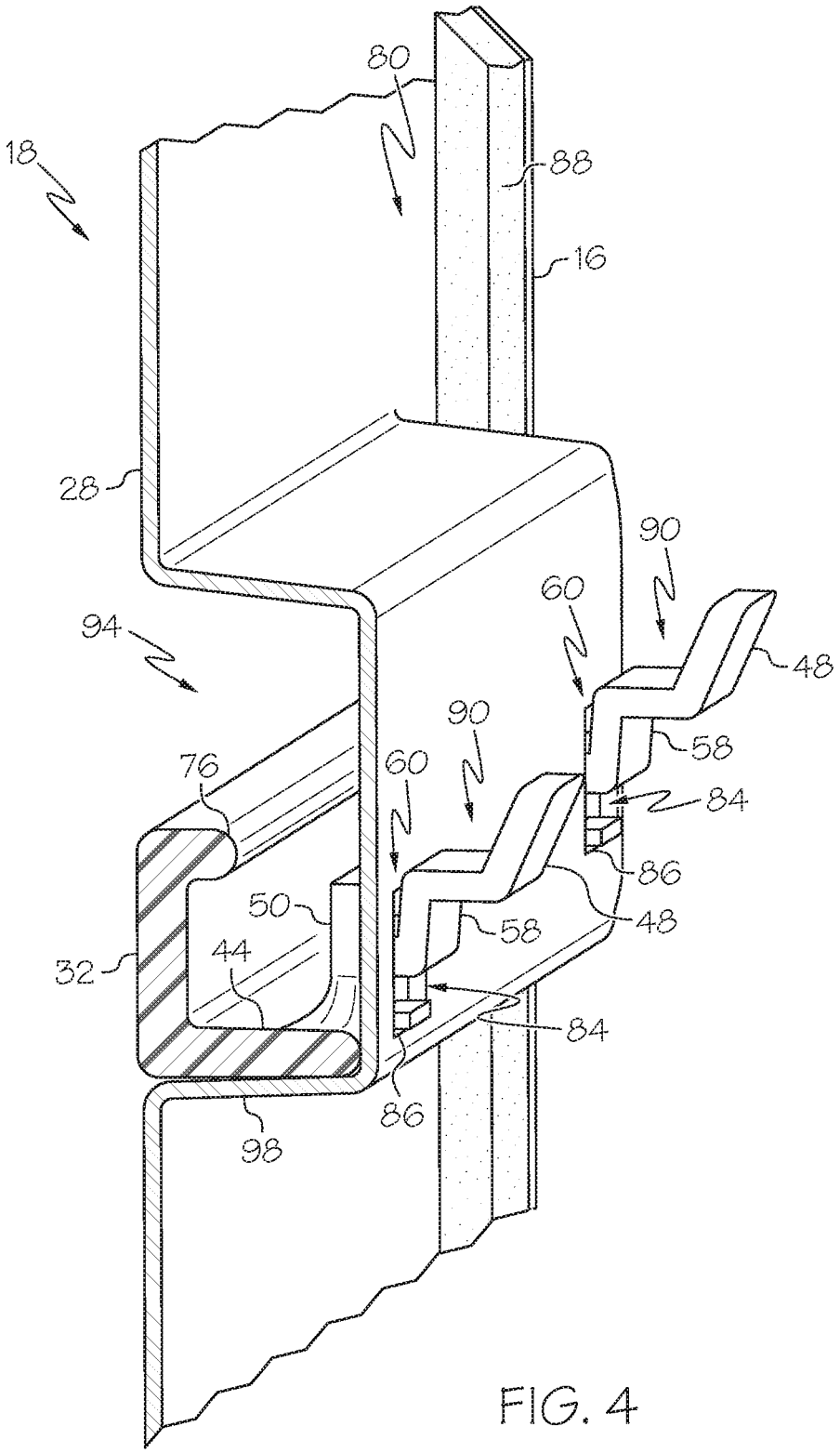
FIG. 4 is a cross-section view of the rail engaged with a liner panel.

Turning to FIG. 4, the rail 32 is engaged with and attached to the liner panel 28 shown prior to assembling the liner panel 28 to the remainder of the door 16 (best seen in FIG. 1). The left side of FIG. 4 represents the interior of compartment 18, or the visible portion of the refrigerator when door 16 is in an opened position. The right side of FIG. 4 represents an interior space 80 between the liner panel 28 and the remainder of the door 16. Each tab 48 of rail 32 passes through an aperture 84 in the liner panel 28. In the shown example, the liner panel 28 defines an individual aperture 84 for each corresponding tab 48, however, other arrangements are also contemplated such as one long aperture that can accommodate several tabs 48. The space 60 defined by the wall 50 and section 58 enables a portion of the liner panel 28 above the aperture 84 to slide between the wall 50 and section 58. Ridge 74 can also interact with the bottom wall 86 of aperture 84.

Various design aspects and manufacturing tolerances of the rail 32, tab 48, ridge 74, and the aperture 84 can be selected such that the rail 32 is positively located in a desired position and/or orientation. Furthermore, the design of these components enables the rail 32 to be held in place as the space between the liner panel 28 and the door 16 is filled with a foaming agent 88. In addition to providing insulation for the door 16 and the compartment 18, the foaming agent 88 holds the rail 32 in place after the foaming agent 88 solidifies. As such, there is no need for additional fastener application to hold the rail 32 in place against the liner panel 28. As such, the tab 48 is foamed into a fixed position behind the liner panel 28 in order to attach the rail 32 to the liner panel 28 and the door 16. Additional fasteners are not needed even if significant loads are placed on the rail 32, such as bins holding relatively heavy containers. It is also to be appreciated that the shape and surface area of the wall 50 (best seen in FIG. 3) can be selected so as to cover the aperture 84 to eliminate and/or reduce the possibility of foaming agent 88 moving through the aperture 84.

As is shown in FIG. 4, the previously described tab structure such as sections 54, 58, 66, and 70 can be designed such that the rail 32 cannot be put into place by linear translation, but can rotated into place for assembly with the remainder of the door 16. Additionally, the angled section 70 at least partially defines a space 90 between the angled section 70 and the rear face of the liner panel 28. This space 90 is filled with the foaming agent 88 during a foaming operation, and the resulting solidified foaming agent 88 in the space 90 helps hold the rail 32 in place after assembly. Similarly, the angled structure of the tab 48 helps provide a significant amount of surface area for the foaming agent 88 to contact in order to hold the rail 32 in place by both friction and physical interference.

FIG. 4 also shows the liner panel 28 defining a rectangular-shaped cavity 94 which is open on one side to the compartment 18. The liner panel 28 includes a wall 98 which partially defines the cavity 94. The bottom portion 44 of the rail 32 can rest on the wall 98 such that the wall 98 gives support to the rail 32 and helps prevent movement of the rail 32, particularly under load. It is also to be appreciated that the rail 32 can be positioned such that no portion of the rail 32 extends from the cavity 94 into the compartment 18. In this manner, the rail 32 does not needlessly occupy storage space within the compartment 18.

Figure 5:
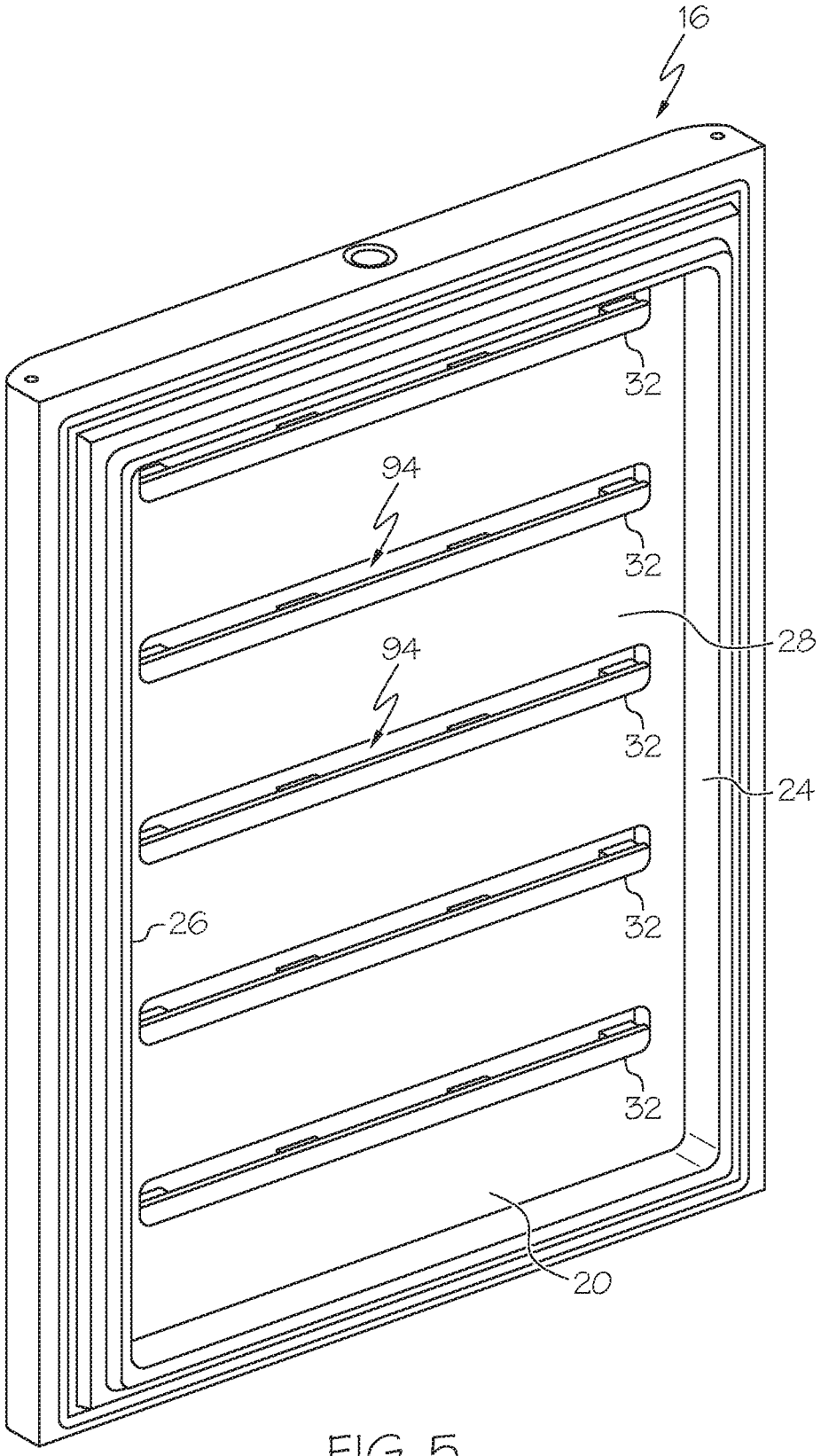
FIG. 5 is a perspective view of the door of FIG. 1 including a plurality of rails of FIG. 2.

Turning to FIG. 5, the door 16 is shown from the side that faces the interior of the compartment 18. As such, this is the side of the door 16 seen by the user when the door 16 is opened to access the compartment 18 after the refrigerator 10 is fully assembled. Five rails 32 are shown mounted to the liner panel 28 of the door 16, however, any suitable number of rails 32 can be arranged on the liner panel 28.

Figure 6:
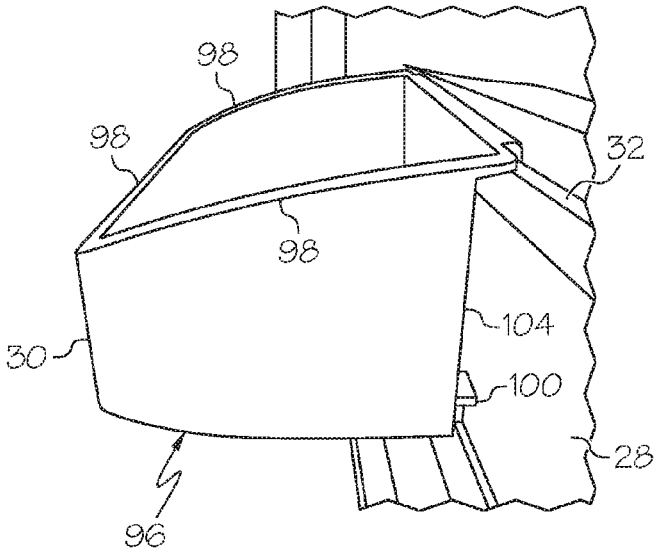
FIG. 6 is a cross-section detail view of the rail of FIG. 2 engaged with the liner panel.

Turning to FIG. 6, the storage system 14 includes a bin 30. This side view shows a bin 30 for storing food items in a temperature-controlled environment, such as the refrigerator 10. The bin 30 can include a substantially-horizontal platform 96 used as a support surface for supporting various objects, such as items that will be stored in the refrigerator 10. The platform 96 can be made of plastic, glass, wire, or any other suitable rigid material. For example, the platform 96 can be a substantially continuous flat support surface. The platform 96 can be coupled to a plurality of upwardly-extending walls 98 to form an open container configured to receive various objects such as food items.

The plurality of walls 98 can upwardly extend from the perimeter of the platform 96 to form a partially enclosed volume. In one example, four walls 98 can extend from the platform 96, and the walls 98 can include various curves, undulations, etc. to correspond to any number of perimeter shapes of the platform 96. In another example, the wall 98 facing a user on the exterior of the refrigerator can be shorter than the remaining walls in order to improve access to the space within the bin 30 and limit necessary lifting required to insert and/or remove objects to and from the bin 30. In a more particular example, the bin 30 may not have a wall facing the user.

The bin 30 also includes at least one bin includes at least one foot 100 extending from a rear surface 104 of the bin 30. The foot 100 contacts the liner panel 28 when the bin 30 is placed into a storage position as shown in FIG. 6. The foot (feet) 100 can help maintain the platform 96 in a substantially horizontal position. In one example, the foot 100 can also provide friction between the foot 100 and the liner panel 28 to help limit side to side movement of the bin 30 as will be described below. It is to be appreciated that the foot 100, walls 98, and the platform 96 can be made of essentially the same material, for example, plastic, glass, wire, or any other suitable rigid material such as a polystyrene composition. In another example, the foot 100 and walls 98 can be molded together with the platform 96 such that the platform 96, the walls 98, and the foot 100 are constructed of one unitary piece.

Figure 7:
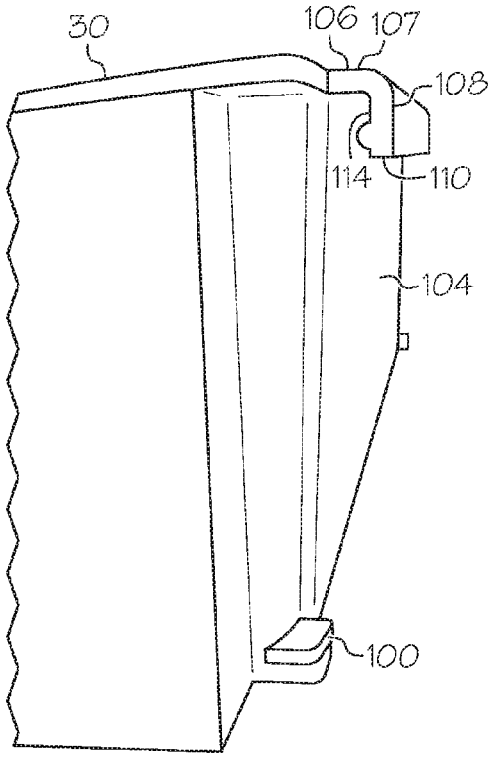
FIG. 7 is a perspective view of a bin in a storage position engaged with the rail and liner panel.

Turning to FIG. 7, the bin 30 includes an arm 106 extending from a rear surface 104 of the bin 30. The arm 106 can be of any suitable shape or orientation including planar configurations, arcuate configurations such as a hook, etc. In the shown example of FIG. 7, the arm 106 can include a substantially horizontal first arm portion 107 extending from a rear surface 104 of the bin 30. While the first arm portion 107 is shown extending from the rear surface 104 at the upper most portion of the rear surface 104, the first arm portion 107 can be placed at any suitable location. The arm 106 can also include a substantially vertical second arm portion 108 extending downward from the first arm portion 107. The second arm portion 108 is configured to be placed between the rail 32 and the liner panel 28 (best seen in FIG. 8) when the bin 30 is placed in a storage position as shown in FIG. 6. The second arm portion 108 can further include a substantially horizontal second protrusion 110 on a front-facing surface 118 of the second arm portion 108.

Figure 8:
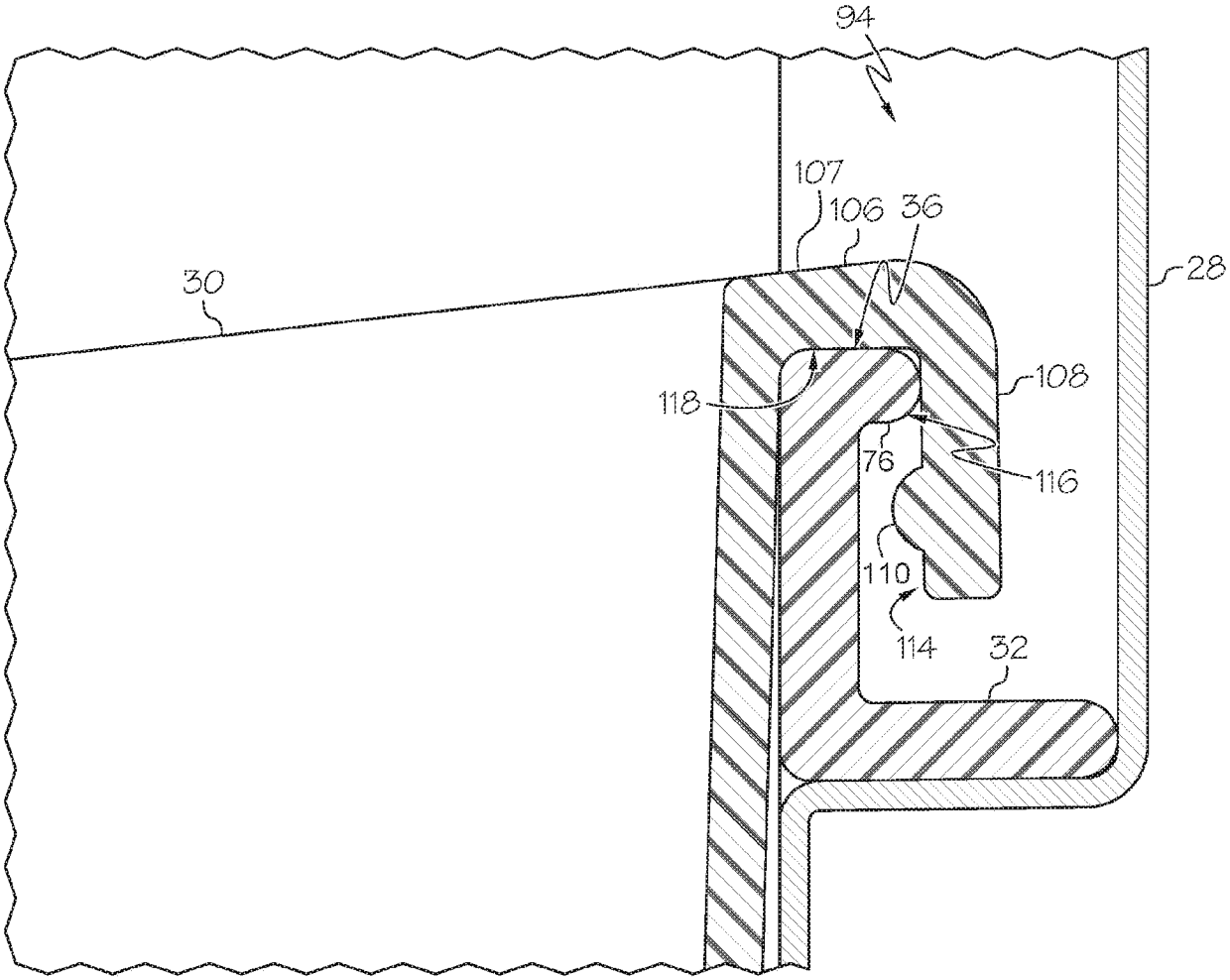
FIG. 8 is a side view of the bin of FIG. 7 showing an arm and a foot.

FIG. 8 shows a cross-section detail of structure included on the bin 30 interacting with structure of the rail 32. The bin 30 is shown in a storage position including the second arm portion 108 placed between the rail 32 and the liner panel 28. In one example, the first protrusion 76 and the second protrusion 110 are configured to interact with each other. As shown in FIG. 8, a distal end 120 of the second protrusion 110 is relatively close to and/or contacts the front-facing surface 118 of the second arm portion 108. This proximity between the first protrusion 76 and the second protrusion 110 create a physical interference when the bin 30 is placed in or removed from the storage position shown in FIG. 8.

This physical interference helps prevent unintentional removal of the bin 30 from engagement with the rail 32. This physical interference can be overcome by application of a relatively small amount of force placed upon the bin 30. When the bin 30 is in the storage position, an adequate amount of force in the upward direction will elastically deform one or both of the first arm portion 107 and the second arm portion 108 such that the first protrusion 76 and the second protrusion 110 pass each other. This enables the bin 30 to be removed from engagement with the rail 32, after which the first arm portion 107 and the second arm portion 108 return to their original shape/position. Similarly, engagement of the bin 30 with the rail 32 require an adequate amount of downward force to elastically deform one or both of the first arm portion 107 and the second arm portion 108 such that the first protrusion 76 and the second protrusion 110 pass each other. After the first protrusion 76 and the second protrusion 110 pass each other, the first arm portion 107 and the second arm portion 108 return to their original shape/position and the second arm portion 108 is located between the rail 32 and the liner panel 28. As such, the bin 30 is placed in the storage position.

Additionally, the bottom surface 122 of the first arm portion 107 contacts the top surface 36 of the rail 32. This contact interaction provides friction force that can overcome a tendency of the bin 30 to slide from side-to-side when the door 16 is opened and closed. In one example, the materials of the first arm portion 107 of the bin 30 and the top surface 36 of the rail 32 can be selected to give rise to a particular desired coefficient of static friction between the bin 30 and the rail 32. As previously discussed, the bin 30 can be constructed of the polystyrene and the rail 32 can be constructed of ABS plastic. As shown in FIG. 8, contact can optionally be maintained between the bin 30 and the rail 32 in other locations as well. As shown in FIG. 6, the feet 100 can also contribute to the friction force between the bin 30 and the rail 32.

Figure 9:
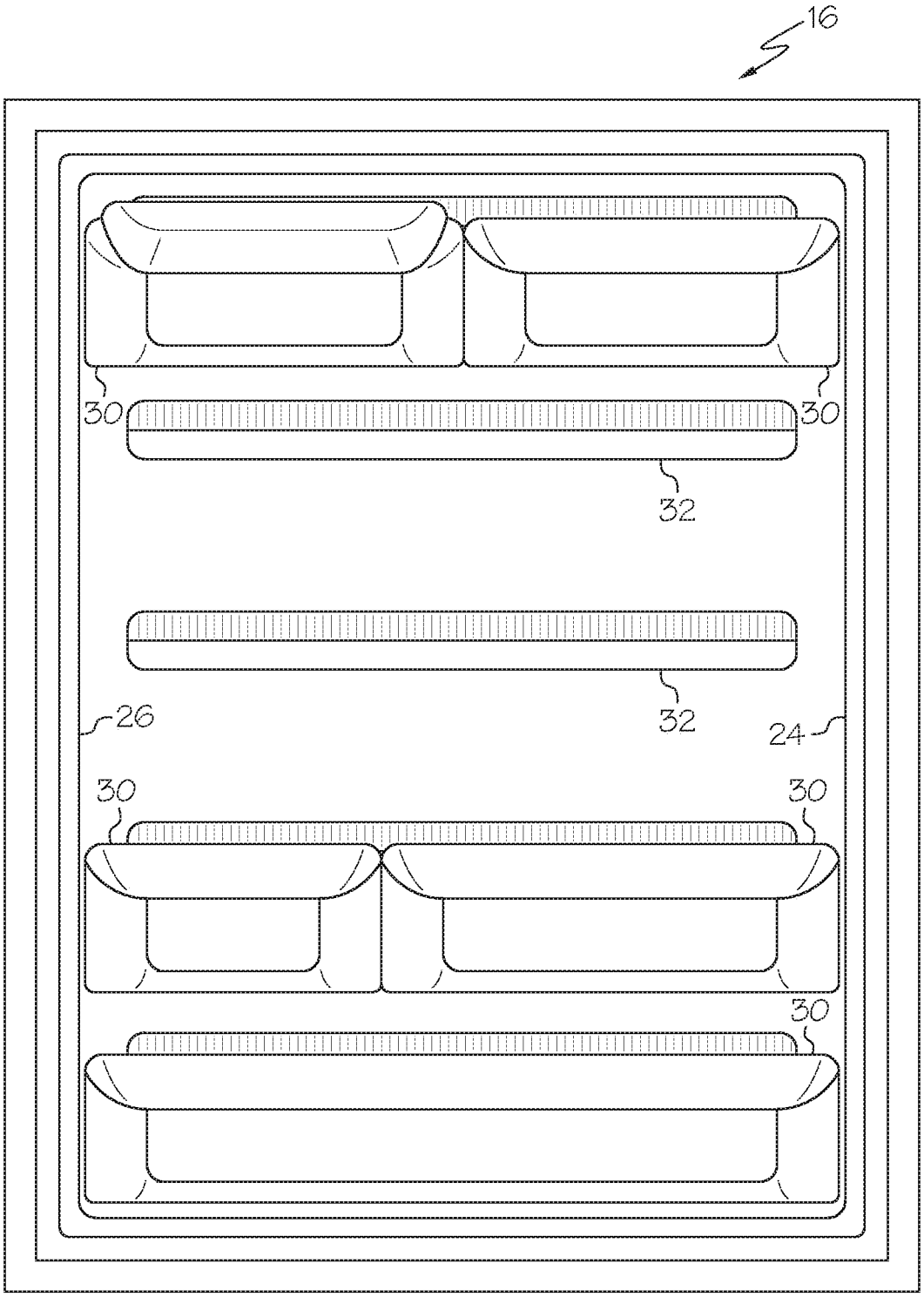
FIG. 9 is a view of the door of FIG. 1 including one example arrangement of storage systems and bins.

Turning to FIG. 9, an interior view the door 16 similar to FIG. 5 is shown with a plurality of bins 30 engaged with a plurality of rails 32. As shown, the bins 30 can include a width that is less than the full width of the rail 32. As such, the bin 30 may be selectively moved from side-to-side along the rail 32. The lower-most bin 30 in this example extends across substantially the entire available width between the right wall 24 and the left wall 26, though it is appreciated that the width of the bin 30 can be varied in any of the example bins 30 as shown in the upper bins 30.

Returning to FIG. 8, at such time when a user chooses to move one or more bins 30 from side-to-side on a rail 32, the friction between the rail 32 and the bin 30 must be overcome. In such a situation, the user can apply an upward force to the bin 30 of lesser magnitude than the previously described force required to remove the bin 30 from the storage position. This force lifts the bottom surface 122 of the first arm 107 a relatively short distance away from the top surface 36 of the rail 32 to reduce the friction force between the bin 30 and the rail 32. In this position, the first protrusion 76 and the second protrusion 110 have not passed each other, and contact between the two can supply a tactile indication to the user that the bin 30 is lifted away from the rail 32 to a satisfactory distance for side-to-side motion. Then, the user applies an additional force in a lateral direction to move the bin 30 sideways. Once the bin 30 is in a desired location, the user can remove both forces, at which time, the bottom surface 122 of the first arm 107 contacts the top surface 36 of the rail 32, and the bin is returned to a storage position. It is to be appreciated that the bins 30 can be positioned along a continuum of locations, and the bin 30 position is not limited by discrete locations such as individual bin or shelf mounts located on the door 16 or the liner panel 28.

Figure 10:
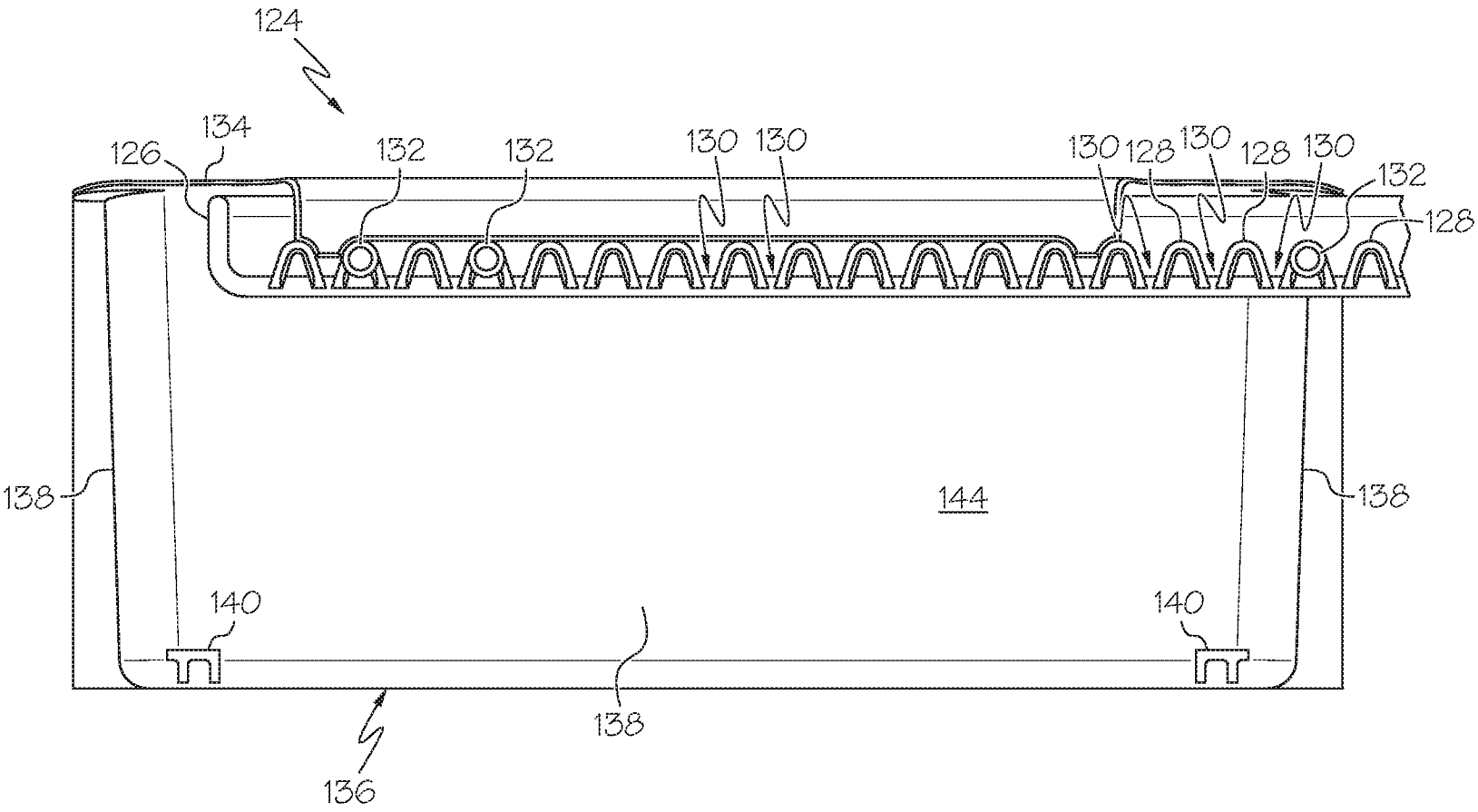
FIG. 10 is an elevation view of the rear of the bin and rail in accordance with another embodiment of the present disclosure, the view omits the liner panel for clarity.

Turning to FIG. 10, an alternative embodiment of a storage system 124 for storing food items in a temperature-controlled environment is shown. FIG. 10 shows a view from the rear of the storage system 124 omitting the previously described liner panel for the purpose of clarity. The storage system 124 includes a rail 126 which includes a plurality of bumps 128. The bumps 128 can be of any suitable shape, size, and orientation. The example shown in FIG. 10 includes bumps 128 that are unitarily molded into the rail 126 and define gaps or spaces 130 between the bumps 128.

While the liner panel is not shown, the rail 126 is attached to the liner panel. In order to facilitate mounting the rail 126 on the liner panel, the rail 126 includes at least one mounting structure. FIG. 10 shows at least one screw boss 132 as an example of a mounting structure, however, this is not meant to be limiting. Any suitable mounting structure may be included on the rail 126. In a further example, the mounting structure may be included on the liner panel. While not shown, a screw may be passed through the liner panel from the liner panel rear surface and threaded into the rail 126 in order to attach the rail 126 to the liner panel. The screw can be used in conjunction with a plate, washer, or other similar structure behind the liner panel in order to limit deformation and/or damage to the liner panel while also increasing the strength of the attachment. In another example, any suitable fastener can be applied to the rail 126 and interact with the liner panel to effect the attachment.

The storage system 124 also includes a bin 134. As with bin 30 of the previous figures, bin 134 can be for storing food items in a temperature-controlled environment, such as the refrigerator 10. The bin 134 can include a substantially-horizontal platform 136 used as a support surface for supporting various objects. The platform 136 can be coupled to a plurality of upwardly-extending walls 138 to form an open container configured to receive various objects such as food items. The bin 134 can also include at least one foot 140 extending from a rear surface 144 of the bin 134. The foot 140 is similar in form and purpose to foot 100 as previously described. Foot 140 contacts the liner panel 28 when the bin 134 is placed into a storage position as shown in FIGS. 6, 10, and 11.

Figure 11:
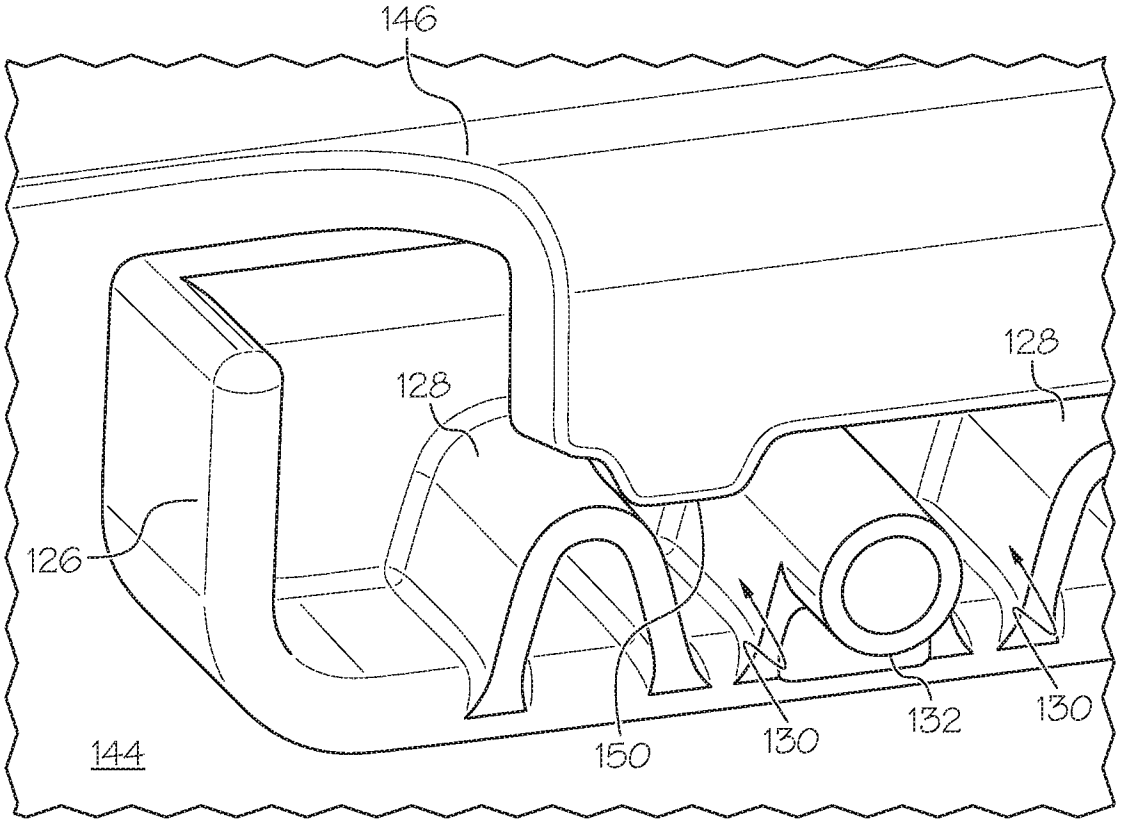
FIG. 11 is a perspective close-up view of the interaction between the rail and the bin of FIG. 10.

Turning to FIG. 11, the bin 134 also includes an arm 146 extending from the rear surface 144 of the bin 134, wherein at least a portion of the arm 146 is placed between the rail 126 and the liner panel when the bin 134 is placed in the storage position as shown in FIGS. 10 and 11. The bin 134 also includes at least one bin tab 150, wherein the bin tab 150 interacts with the bumps 128 of the rail 126. In the shown example, the bin tab 150 can be designed to fit within the spaces 130 between the bumps 128. In this way, the bumps 128 and the bin tab 150 can create a physical interference that can prevent unintentional side to side movement of the bin 134, such as when the refrigerator door (best seen in FIG. 1) is opened or closed. As such, the bin tab 150 interacts with the bumps 128 of the rail 126 to prevent side to side movement of the bin 134 when the bin 134 is placed in the storage position.

The described storage system and refrigeration appliance include several advantages. The above described liner panel does not require any "action" or moving parts within the tooling. Previous liner panel designs included undercuts which necessitated action elements within the thermoform tool. Action elements increase the initial cost and maintenance costs for the tool.

At least one embodiment of the described storage system and refrigeration appliance also does not require mechanical fasteners to attach the rail to the liner panel. Previous designs included fasteners, some in the space between the liner panel and the exterior door panel. These fasteners detrimentally increased the time and expense of assembly.

Another advantage of the described storage system and refrigeration appliance is an improved resistance to rail break-away from the liner panel under heavy load conditions. An additional advantage of the described bin and refrigeration appliance is the possible location of bins along a continuum of horizontal locations with relatively low additional cost to the manufacturing and assembly process. The storage system also provides much more flexibility for the user to arrange storage components within the refrigerator. For example, the insertion of relatively tall items into lower bins on the door may require additional space above the lower bins. With the described storage system, the user can simply move a higher bin to a side to more easily store the relatively tall items in the lower bins.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A storage system for storing food items in a temperature-controlled environment, the storage system comprising:

a rail attached to a liner panel, the rail including a plurality of bumps extending along a longitudinal length of the rail, each bump being formed as a raised portion extending from a surface of the rail and defining gaps or spaces between adjacent ones of the plurality of bumps, and at least one mounting structure to secure the rail to the liner panel; and a bin, the bin including:

an arm extending from a rear surface of the bin, wherein at least a portion of the arm is configured to be placed between the rail and the liner panel when the bin is placed in a storage position;

at least one bin tab, wherein the at least one bin tab is configured to interact with the bumps of the rail in order to prevent side to side movement of the bin when the bin is placed in the storage position, wherein:

the at least one bin tab is configured to fit within a selected one of the gaps or spaces between said plurality of bumps, and the at least one mounting structure is formed within and substantially through an associated one of the plurality of bumps and is configured to receive a fastener to secure the rail to the liner panel.

2. The storage system of claim 1, the bin further including at least one foot extending from the rear surface of the bin which contacts the liner panel when the bin is placed into the storage position.

3. The storage system of claim 2, wherein the foot is molded together with the bin as a unitary piece.

4. The storage system of claim 1, wherein the bumps and the at least one bin tab are configured to create a physical interference that prevents unintentional side to side movement of the bin.

5. The storage system of claim 1, wherein the bumps are unitarily molded into the rail.

6. The storage system of claim 1, wherein the at least one mounting structure is a screw boss.

7. The storage system of claim 1, wherein the at least one bin tab comprises a plurality of bin tabs, each respectively configured to simultaneously fit within the gaps or spaces between the plurality of bumps.

8. The storage system of claim 1, wherein the bin is configured to be secured to the rail by vertically lifting the bin and dropping the at least one bin tab within the selected one of the gaps or spaces between the plurality of bumps.

* * * * *